US005667369A

United States Patent [19]

Cholet

[11] Patent Number: 5,667,369

[45] Date of Patent: Sep. 16, 1997

[54] VOLUMETRIC PUMP DRIVEN BY A CONTINUOUS TUBE

[75] Inventor: Henri Cholet, Le Pecq, France

[73] Assignee: Institut Francais Du Petrole, Rueil Malmaison, France

[21] Appl. No.: 563,056

[22] Filed: Nov. 27, 1995

[30] Foreign Application Priority Data

Nov. 25, 1994 [FR] France ..... 94/14.263

[51] Int. Cl.[6] ..... F04B 47/00

[52] U.S. Cl. ..... 417/448; 417/362; 166/68.5; 166/105

[58] Field of Search ..... 417/362, 410.3, 417/448, 904; 418/48; 166/68, 68.5, 105

[56] References Cited

U.S. PATENT DOCUMENTS

| | | | |
|---|---|---|---|
| 3,989,418 | 11/1976 | Swanson, Jr. | 417/405 |
| 4,024,913 | 5/1977 | Grable | 166/68 |
| 4,416,329 | 11/1983 | Tanner et al. | 166/68 |
| 4,476,923 | 10/1984 | Walling | 166/68 |
| 5,180,014 | 1/1993 | Cox | 166/68 |
| 5,211,203 | 5/1993 | Vollweiler et al. | 137/355.17 |
| 5,447,200 | 9/1995 | Dedora et al. | 166/105 |

FOREIGN PATENT DOCUMENTS

| | | |
|---|---|---|
| 0 322 958 | 7/1989 | European Pat. Off. . |
| 0 482 912 | 4/1992 | European Pat. Off. . |
| 2 656 652 | 7/1991 | France . |
| 2 696 792 | 4/1994 | France . |

*Primary Examiner*—Charles G. Freay

*Attorney, Agent, or Firm*—Millen, White, Zelano, & Branigan, P.C.

[57] ABSTRACT

This invention relates to a system for pumping an effluent that is produced by a geological formation, in which a rotary pump (3) is installed and driven in rotation by a continuous tube (12) that rises up to the surface. The tube makes it possible to inject a fluid, for example, a liquefier or a lubricant. This invention also relates to a pumping method in which rotor (24) of the pump is installed with a continuous tube (12), of the "coil tubing" type.

11 Claims, 3 Drawing Sheets

VOLUMETRIC PUMP DRIVEN BY A CONTINUOUS TUBE

BACKGROUND OF THE INVENTION

This invention relates to a method and a system for production of hydrocarbon by pumping that is particularly suited to deposits of viscous oil.

Document FR-2692320, which describes a pumping device for viscous fluids that comprises the injection of a liquefying product upstream from the suction of the pump, at the oil-gas separation orifices, is known. This device exhibits in particular the drawback of requiring an additional operation for the installation of a special pipe for the injection of the product. Moreover, the pump should have the capability of handling the oil flow that is produced by the increased formation of the flow of the injected liquefying product.

SUMMARY OF THE INVENTION

Thus, this invention relates to a method for pumping an effluent that is produced by a well that is drilled into a geological formation, in which means of pumping that comprise a rotor and a stator are placed at the base of a column that is submerged in said effluent. The method comprises the following stages:

- means of diffusion and said rotor are attached to one end of a continuous tube that is wound on a drum,
- said means of diffusion and said rotor are lowered inside of said column by unwinding said tube from the drum,
- said rotor is placed in the stator, with said means of diffusion being located in the vicinity of the output of the pump,
- said tube is driven in rotation to activate the pump.

It is possible to adjust the position of the tube relative to said column by adjusting the connecting means of the tube.

It is possible to inject a fluid via said tube.

At least a portion of the effluent can rise via the inner channel of the tube.

The pumping means can be lowered into the well by two concentric tubes that are wound on the same drum, whereby said concentric tubes constitute said column and said continuous tube.

The invention also relates to a system for pumping an effluent that is produced by a well that is drilled into a geological formation, in which pumping means that comprise a rotor and a stator are placed at the base of a column that is submerged in said effluent. The system comprises:

- a continuous tube that is suited to being wound on a drum, with said tube being in the inner space of said column and being integral with the rotor,
- means of diffusion attached to the end of said tube, with diffusion means being placed between the rotor and said tube,
- means of driving the tube in rotation to activate the pump.

On the surface of the ground, the system can comprise means of adjusting the length of the continuous tube relative to said column.

The diffusion means can be located downstream from the output of the pump.

The column can be a continuous tube that is suited to being wound on a drum.

The method and the system according to the invention can be applied to greatly deviated wells, for example, wherein the inclination of the well is at least 60° in relation to the vertical.

DESCRIPTION OF THE DRAWINGS

Other characteristics and advantages of the system according to the invention will become clearer by reading the description below of embodiments that are described as nonlimiting examples, with reference to the accompanying drawings where.

DETAILED DESCRIPTION OF THE DRAWINGS

Figures 1, 5:
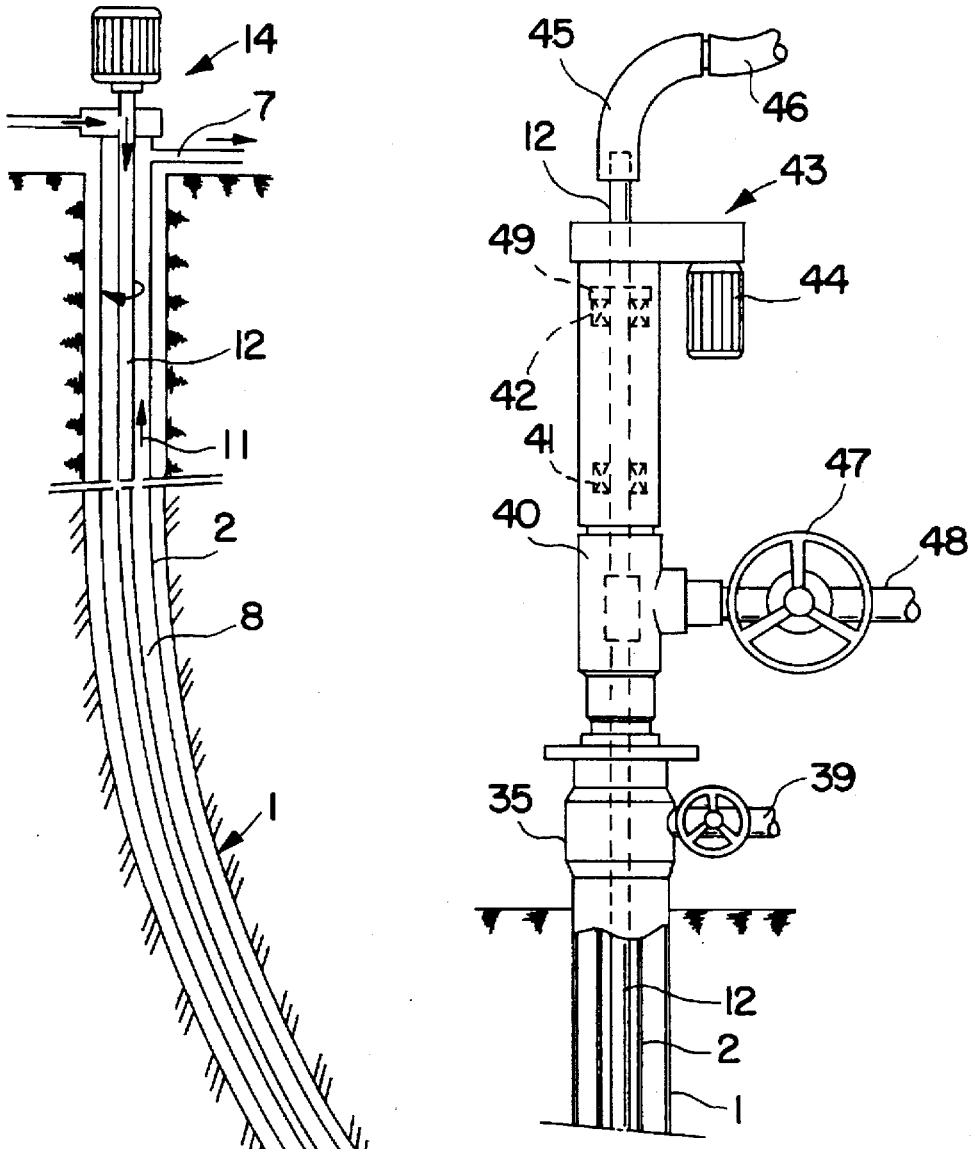
FIG. 1 diagrammatically depicts a pumping system according to the invention.
FIG. 5 shows an embodiment of the surface means that makes it possible to drive the tube in rotation, inject the fluid in the tube, and return the product.

In FIG. 1, a well 1 reaches a geological formation that produces an effluent which contains hydrocarbons. The pressure that prevails in the formation is too low for the effluent to be able to rise to the surface. The productive formation is called noneruptive. The production plan therefore requires the use of a system for pumping of the effluent.

Effluent is to be defined to include all the fluids that are present in well 1. In the case where the hydrocarbon, contained in said formation, is viscous, it is possible to inject water vapor, or other fluids, to liquefy the hydrocarbon to promote its flow. When the injection of liquefying fluid is upstream from the intake of the pump, there is a fairly large amount of effluent to be moved by pumping, relative to the volume of hydrocarbon produced by the formation. This large volume of effluent then calls for a pumping capacity that is larger than that which would be necessary to process the volume of the hydrocarbon itself. It is therefore preferable to inject the liquefying fluid downstream from the output of the pump so that the fluidification lowers the effluent circulation head losses in the production pipe that rises up to the surface, without having to increase the pumping capability of the pump. In the majority of pumping wells, the head losses downstream from the pump are detrimental to the determination of the pumping conditions.

Well 1 is equipped with a tubular column 2 whose lower end is immersed in the effluent. The annular space, defined between well 1 and the outside of column 2, can be sealed or not by a sealing system of the packer type (not shown here). Column 2, in general called a "production column," has as its main role the channeling of the product from the bottom to the surface of the ground via its inner pipe.

A pumping system 3 is positioned approximately at the end of column 2 by a seat or connection 4. Connection 4 has at least the function of securing the stator of pump 6 longitudinally and in rotation relative to column 2. Preferably, this connection 4 is fluidtight between the case of pump 6 and column 2. An opening 5 makes it possible to intake the effluent into the case of pump 6.

An opening 7 makes it possible to output the effluent that is fed into inner annular space 8 of column 2. Arrows 9, 10 and 11 indicate the path of the effluent.

A continuous tube 12 is connected to the rotor of the case of the pump by its lower end, whereby the upper end located on the surface of the ground works with means 14 which are detailed in FIG. 5.

Pumping system 3 is preferably installed in seat or connection 4 at the surface of the ground before column 2 is lowered into well 1, with the raising of the system being performed by the reverse operation.

Inner space of tube 12 makes it possible to inject a fluid in the direction indicated by arrows 15.

The driving of tube 12 in rotation causes the rotation of the rotor (not shown in this figure) of the case of pump 6.

The fact that inner tube 12 in column 2 is continuous, i.e., without intermediate connection, provides several advantages, particularly:

the head losses of the fluid in circulation in inner annular space 8 are not increased by the presence of a large number of constrictions of the section due to connections of pumping rods or tubings that are conventionally used for this use, when tube 12 is put into rotation, it is deformed elastically by torsion; when the rotation stops, or if there is a significant reduction in the resistant torque, the tube tends to resume its rest position by performing rotation in the opposite direction. In the known case where the rotor of the pump is driven by a tube seal or screwed-rod seal, the latter can be unscrewed partially or completely. This problem is well known in the profession and has become very troublesome, particularly in the case of pumping in wells that are greatly deviated or that exhibit significant friction of the rotary seals in the production column. The use of a continuous tube as in this invention resolves this problem:

handling of the rotor is done quickly without having to screw the lengths of tubes or rods end to end, the continuous tube makes it possible to inject a fluid above the rotor, in the case where fluid is not injected through the channel of the continuous tube, its inner space can be used to raise the effluent fed by the pump as a supplement to annular space 8. Head losses are thus reduced.

Figure 2:
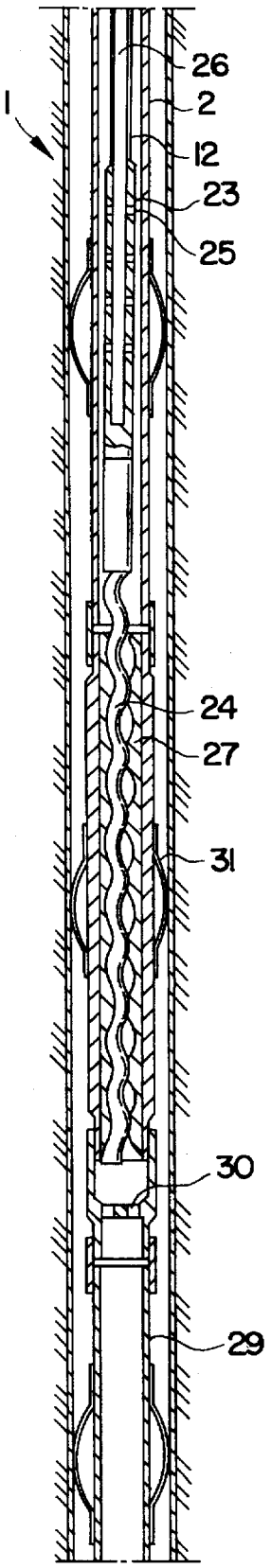
FIG. 2 depicts a volumetric pump that is equipped with a diffusion system.

FIG. 2 shows pumping system 3 that is attached at the end of column 2 and centered in well 1 by centering devices 31. At its end, continuous tube 12 comprises diffusion means 23 that are interposed between continuous tube 12 and rotor 24. Diffusion means 23 comprise a series of orifices 25, by which the fluid injected via inner channel 26 of tube 12 is diffused. At the lower part of stator 27, the effluent produced by the formation penetrates into the intake of the pump via orifices 30 in communication with intake pipe 29 in an extension to the pump case.

Figure 3:
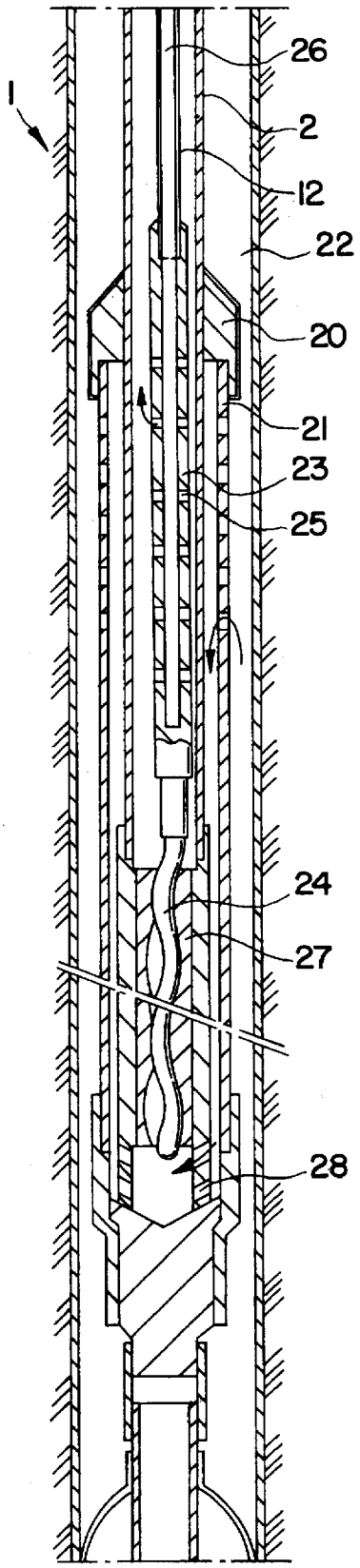
FIG. 3 depicts a variant of the pumping system that comprises a degassing system.

FIG. 3 shows a variant embodiment of the pumping system according to the invention. Column 2 comprises a connection 20 that is screwed above an effluent intake device 21; the device can be a static liquid/gas separator, for example, the one described in patent FR-2656652. In the case where free gas is present in the effluent, the annular space between column 2 and well 1 is used to channel gas 22 up to the surface.

Figure 4B:
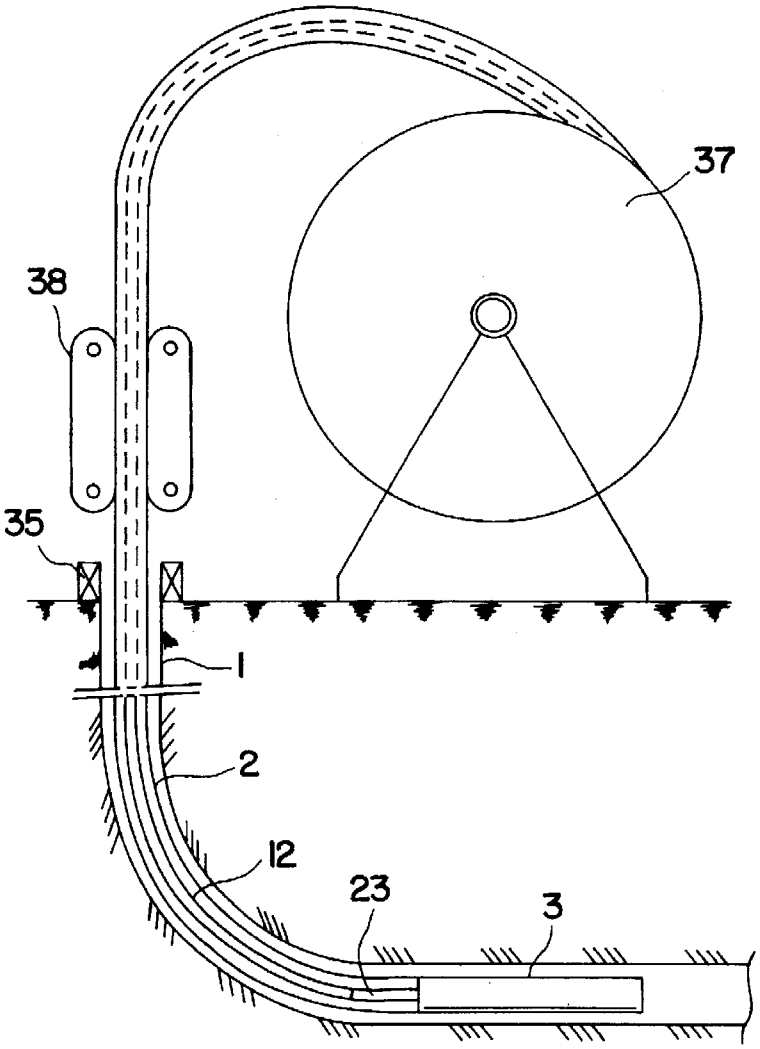
FIGS. 4A and 4B illustrate a method and a variant for installation of the pumping system.

At its end, tube 12 comprises diffusion means 23 that are interposed between continuous tube 12 and rotor 24. Diffusion means 23 comprise a series of orifices 25 by which the fluid that is injected via inner channel 26 of tube 12 is diffused. In the lower part of stator 27, the effluent that is produced penetrates into the intake of the pump by orifices 28 that are located at the base of separation system FIGS. 4A and 4B show a method and a variant way of installing the production system according to the invention.

Figure 4A:
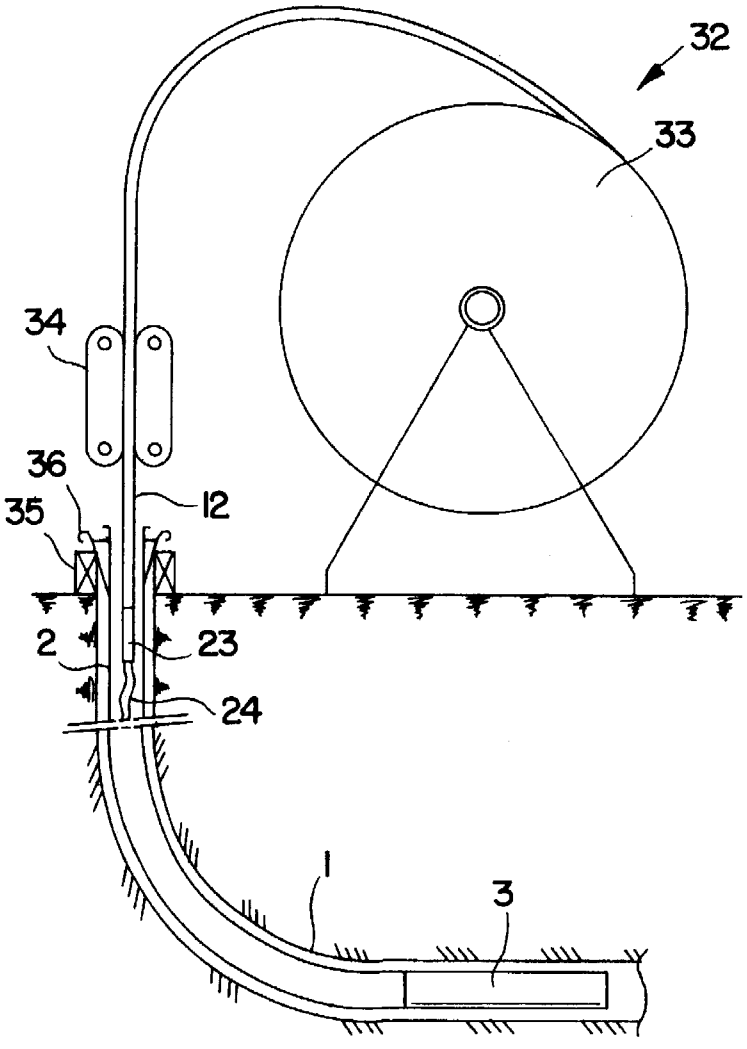

FIG. 4A shows a pumping system 3 that is lowered into a well 1 at the end of a column 2. At the surface, column 2 is hooked to wellhead means 35 by suspensions 36. Column 2 here preferably consists of tubular elements that are assembled by screwing, for example, so-called "tubing" tubes according to the standards of the American Petroleum Institute.

Continuous tube 12 of the "coil tubing" type is wound on drum 33 of a reel 32. Handling means 34, of the chain type, makes it possible to insert tube 12 into the inner space of column 2 or retract it. Means for diffusing a product that can be injected by the channel of tube 12 are attached to the end of continuous tube 12. The rotor of the pump is attached to the end of these diffusion means.

The lowering of the rotor is done in a continuous manner by unrolling the tube from drum 33 and under the action of handling means 34. Once rotor 24 is introduced in the stator of pump 3, tube 12 is cut so that its upper end extends from the wellhead. Installations for suspension, motorization, and injection are placed on the end of tube 12, for example as shown in FIG. 5.

The continuous tube can be a "coil tubing" of nominal size 1½" (3.81 cm outside diameter). Such a tube has a resistance to torsion that is at least equivalent to the torque with which conventional pumping rods (1⅛" sucker rod) are screwed and greater than the torque with which tubings of nominal size 1.66" according to the API standard are screwed.

The variant illustrated by FIG. 4B shows that pumping system 3 is lowered into well 1 by a unit consisting of two concentric "coil tubings" that constitute column 2 and tube 12. Pumping system 3 is attached to outside continuous tube 2, and the rotor is attached to inside continuous tube 12. The lowering of the pumping system is done in a continuous manner by unrolling the tube from drum 37 and under the action of handling means 38. When the pumping system is positioned at the specified depth, tube 2 is suspended and attached to wellhead 35, and then tube 12 is cut so that its upper end extends from the wellhead. Installations for suspension, motorization and injection are placed on the end of tube 12, for example as shown in FIG. 5.

FIG. 5 shows the surface installations which cover well 1. The base element of wellhead 35 is attached to the surface column of well 1. Column 2 is suspended in the base element by corners or any other equivalent system known in the profession. Valve 39 communicates with the annular area that is defined by the outside of column 2 and well 1. Element 40 that is assembled on the base element comprises a central passage that is in communication with the inner space of column 2. Tube 12 is in said central passage. Element 40 comprises sealing means 41 between tube 12 and said passage, so that the effluent which rises from the bottom of the well through the annular space between column 2 and the outside of tube 12 is channeled toward pipe 48 to which safety valve 47 is attached. Sealing means 41 are of the stuffing box type on a rotating element. A rotary bearing 42 on which rests a shoulder 49 that is integral with tube 12 supports the weight of the tube that is driven in rotation by mechanical means 43 and a motor 44. A rotating connection 45 is attached to the end of tube 12 to make it possible to inject a fluid into tube 12 via pipe 46 which communicates with injection means (not shown).

To make it possible to adjust tube 12 in longitudinal position relative to the position of the stator of the pump, shoulder 49 can consist of a two-part collar that is clamped around the tube.

This invention also relates to the case where the injection of the liquefying product downstream from the pump can be intermittent or even eliminated. In this case, the effluent that is fed can also rise into tube 12, and pipes 46 and 48 will then be joined.

This invention also relates to a continuous tube 12, optionally a continuous column 2, made of composite material, for example, of reinforcement fibers clad in a resin matrix.

Without further elaboration, it is believed that one skilled in the art can, using the preceding description, utilize the present invention to its fullest extent.

In the foregoing examples, all temperatures are set forth uncorrected in degrees Celsius and unless otherwise indicated, all parts and percentages are by weight.

The entire disclosures of all applications, patents and publications, cited above, and of corresponding French application 94/14.263, are hereby incorporated by reference.

What is claimed:

1. A method of pumping an effluent that is produced by a well that is drilled into a geological formation, in which pumping means (3) that comprise a rotor (24) and a stator (27) are placed at the base of a column (2) that is submerged in said effluent, characterized in that it comprises the following stages:

winding a continuous tube (12) onto a drum (33) said tube having means of diffusion (23) and said rotor (24) attached to one end of said continuous tube (12), lowering said means of diffusion and said rotor into the inner space of said column (2) by unwinding said tube (12) from drum (33), said rotor is placed in the stator, with said means of diffusion being located in the vicinity of the output of the pump, said tube is driven in rotation to activate the pump.

2. A method according to claim 1, wherein the position of tube (12) is adjusted relative to said column (2) by acting on connecting means (49) of the tube.

3. A method according to claim 1, wherein a fluid is injected through said tube.

4. A method according to one of claim 1, wherein at least a portion of the effluent rises via the inner channel of tube (12).

5. A method according to claim 1, wherein the pumping means are lowered into the well by two concentric tubes that are wound on the same drum (37), whereby said concentric tubes constitute said column and said continuous tube.

6. A method according to claim 1, wherein the well is a deviated well disposed at an angle at least 60° from the verticle.

7. A system suitable for pumping an effluent that is produced by a well that is drilled into a geological formation, comprising:

a pump (3) comprising a rotor (24) and a stator (27), a coilable column (2) adapted to be submerged in said effluent said pumping means being disposed at the base of the column, a continuous coilable tube (12) adapted for winding in a coil on a drum (33), with said tube being in the inner space of said column and being integral with the rotor, means (23) for diffusing attached to the end of said tube (12), with the diffusing means 23 being placed between the rotor (24) and said tube (12), means (43, 44) for driving the tube (12) in rotation to activate the pump (3), and means for fixing the stator (27) to the base of the column (2).

8. A system according to claim 7, wherein on the surface it comprises means (49, 42) for adjusting the length of the continuous tube (12) relative to said column(2).

9. A system according to claim 7, wherein the diffusing means (23) is located downstream of the output of the pump (3).

10. A system according to claim 7, wherein said coilable column (2) is a continuous tube adapted for winding in a coil on a drum (37).

11. A system according to claim 7, wherein the well is a deviated well disposed at an angle at least 60° from the verticle.

* * * * *